United States Patent [19]

Motooka et al.

[11] 4,338,282

[45] Jul. 6, 1982

[54] SELECTIVE COLLECTING SYSTEM OF WASHINGLY TREATED ARTICLES

[75] Inventors: Setsuzo Motooka, Toyonaka; Yukihiro Karigane, Osaka; Osamu Yamazaki, Kishiwada; Osamu Ochiai, Habikino, all of Japan

[73] Assignee: Duskin Franchise Co., Ltd., Osaka, Japan

[21] Appl. No.: 167,765

[22] Filed: Jul. 14, 1980

[30] Foreign Application Priority Data

Jan. 18, 1980 [JP] Japan ..... 55/4690
Jan. 19, 1980 [JP] Japan ..... 55/4693

[51] Int. Cl.[3] ..... B08B 3/04; A61L 2/06

[52] U.S. Cl. ..... 422/105; 28/170; 68/5 C; 68/9; 134/15; 226/45; 242/67.4; 422/26; 422/297; 422/298; 422/299

[58] Field of Search ..... 134/9, 15; 422/26, 105, 422/109, 110, 297, 299, 298; 68/5 C, 9; 28/170; 242/67.4; 226/45

[56] References Cited

U.S. PATENT DOCUMENTS 2,609,623 9/1952 Miller ..... 68/9 X
2,655,022 10/1953 Wells ..... 68/9 UX
2,846,862 8/1958 Morrill ..... 68/9 X
3,007,815 11/1961 Richter ..... 134/15
3,037,163 5/1962 Wiprud ..... 226/45 X
3,182,536 5/1965 Sumpter et al. ..... 226/45 X
3,505,004 4/1970 Pfeil ..... 68/9 X
3,646,785 3/1972 Arioli ..... 68/9 X

FOREIGN PATENT DOCUMENTS 52-2077 1/1977 Japan ..... 134/9

OTHER PUBLICATIONS

"Separator", Tubular Textile Machinery, Printed U.S.A.

*Primary Examiner*—Barry S. Richman
*Attorney, Agent, or Firm*—Cushman, Darby & Cushman

[57] ABSTRACT

A system for selectively collecting washed articles with a washing device and conveyor to convey the articles therethrough, first and second detectors for detecting fabric faults and improperly washed articles, respectively, a device to roll the articles, a control device for controlling the washing treatment and a distributing device in response to signals generated by the detectors.

6 Claims, 4 Drawing Figures

SELECTIVE COLLECTING SYSTEM OF WASHINGLY TREATED ARTICLES

BACKGROUND OF THE INVENTION (1) Field of the Invention

The present invention relates to a selective collecting system of washingly treated articles, for example rolled towels which are regenerated by washing and collected for repeat use.

The term rolled towels as used herein means towels to be used in the form of a roll of towel at lavatories at home, offices, restaurants and hotels as rental goods.

(2) Description of the Prior Art

Conventionally, washingly treated articles have not been inspected for damage after the washing treatment was performed. Therefore, such treated articles have automatically been circulated as articles to be re-used, even if damaged through use or washing. For example, rental rolled towels which have been repeatedly used have been recirculated on the market pierced with holes or having frayed edges. Therefore, confidence of the users on such articles has considerably been lowered.

SUMMARY OF THE INVENTION

It is an object of the present invention to provide a system of selecting articles according to their damage as to holes or tears resulting from use or washing, thereby collecting the articles having a desired quality, in an easy and rapid manner.

In order to achieve the object above-mentioned, a selective collecting system of washingly treated articles according to the present invention comprises a detector for detecting damage of treated articles after washing treatment, a selective collecting device for selectively collecting the treated articles and a control mechanism for automatically selecting the selective collecting position in the selective collecting device according to a result detected by the detector.

According to the present invention, damage of treated articles may be detected after washing treatment and such articles are selectively collected based on such detection. Thus, after washing treatment and prior to the circulation of such articles as goods for re-use, their damage may securely be detected regardless whether such damage is resulted from the use or washing, and articles having a desired quality may be collected readily and speedily.

Accordingly, the entire working efficiency may be improved. In the particular case where such articles are rental rolled towels to be repeatedly used, such towels that are unexpectedly pierced with holes are prevented from being circulated on the market thereby lowering public confidence. Thus, the present invention may provide a great practical effect.

It is another object of the present invention to prevent, in sterilization of such towels above-mentioned, sticking of stains to such towels due to dew condensation and deterioration of the towel fibers as a result of conventional sterilization with the use of chloric type chemicals. Thus, good quality towels capable of being repeatedly used may be collected.

Other objects and advantages of the present invention will be apparent from the following description.

BRIEF DESCRIPTION OF THE DRAWINGS

The present invention will be further described, by way of example, with reference to the accompanying drawings, in which.

DETAILED DESCRIPTION OF THE PREFERRED EMBODIMENTS

Figure 1:
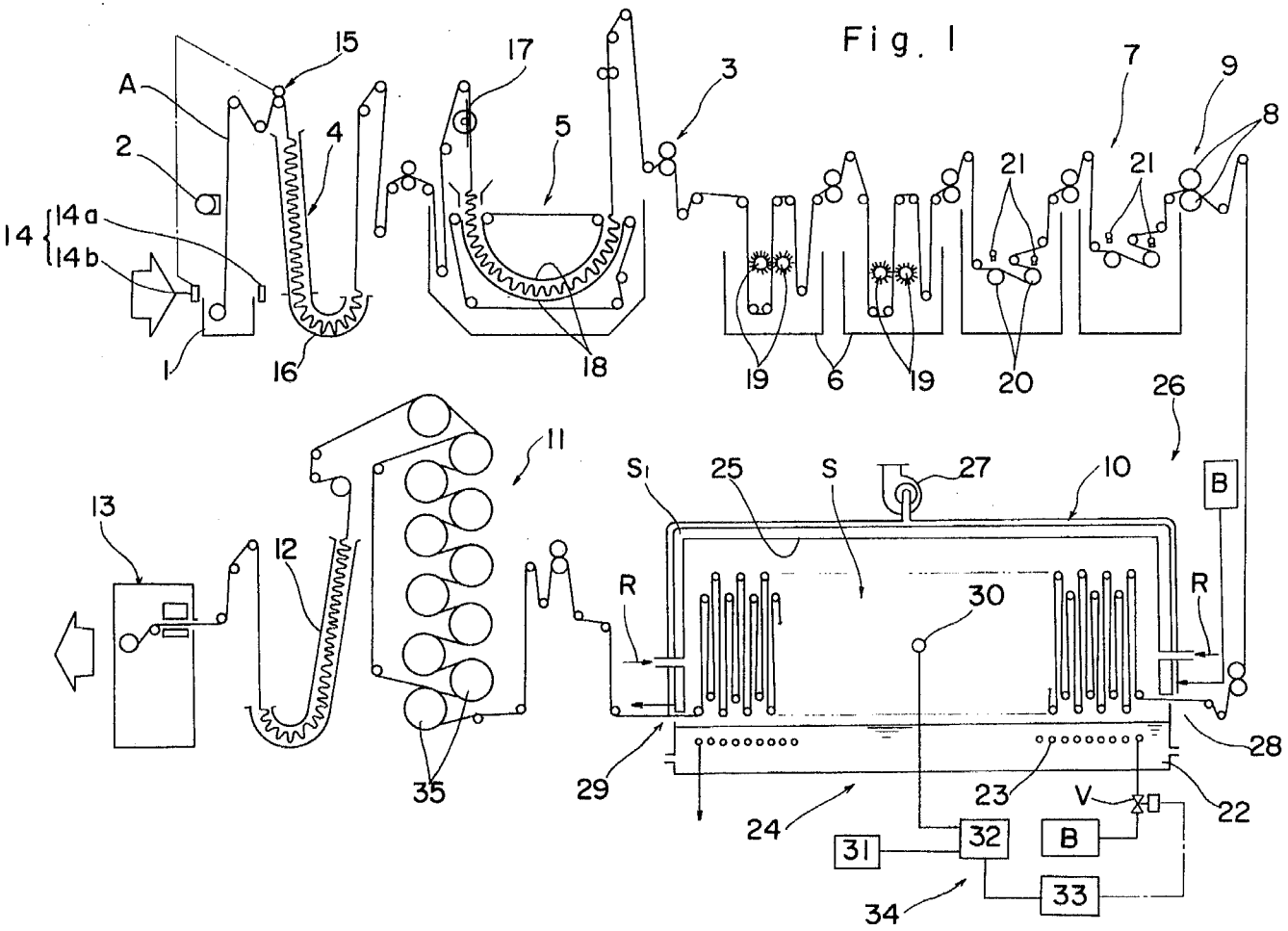
FIG. 1 is a general flow sheet of a selective collecting system of washingly treated articles in accordance with the present invention which is applied to the continuous washing of rolled towels.

A rolled towel continuous washing system for efficiently washing a plurality of rolled towels comprises a storage tank 1 in which used towels A collected in the wound state are stored, a sewing machine 2 for connecting the longitudinal ends of towels A taken out of the storage tank 1 while being unwound thereby forming such towels into a band shape, a conveyor system 3 through which band-like towels are continuously conveyed to an inlet-side accumulator unit 4, an immersion tank 5, washing tanks 6, rinsing tanks 7, a dehydrating means 9 having a pair of wringing rollers 8, a sterilizing device 10, a drying device 11 and an outlet-side accumulator unit 12, and a selective collecting device 13 by which towels A are windingly collected one by one.

A washing solution of a surface active agent mixed with a supplementary agent is supplied to and stored in the immersion tank 5 with its concentration and temperature controlled.

The sterilizing device 10 is constructed so as to sterilize band-like towels with steam. Thus, in the continuous washing system according to the present invention, no chloric type chemicals are used, thereby greatly reducing deterioration of the towel fibers, which may otherwise result from washing and sterilization.

A detector device 14 comprising a projector means **14*a* and a light receiving means 14*b* is disposed between the storage tank 1 and the sewing machine 2. This detector device 14 is constructed so as to detect the ends of towels A, based on the principle that the amount of received light is increased when the ends of towels A pass through the detector device 14. The detector device 14 is interlocked with a drive roller unit 15 for feeding band-like towels to the inlet-side accumulator unit 4. When the ends of towels are detected, towel transfer is automatically stopped with the ends of towels transferred to the position where towels are connected to each other by the sewing machine 2**.

At the inlet-side accumulator unit 4, band-like towels are adapted to be fed to and stored, in a folded state, in a J-shape container 16 having a lateral side made of acryl plate such that the inside therein may be visible. Thus, intermittent connection of towels A by the sewing machine may be performed without injuring the continuity of the succeeding treatments.

The container 16 has a weight detector means (not shown) with which a buzzer is interlocked, so that the sewing machine operator may be informed of whether a detected weight exceeds or is less than a predetermined weight range by the sound of the buzzer. Thus, the operator's attention may be captured so that he can interrupt the towel connecting operation when the wound stress is increased, and increase the speed of the towel connecting operation when the wound stress is diminished. Accordingly, the amount of towel storage may be maintained within a predetermined range so that succeeding continuous operations may efficiently be performed.

The immersion tank 5 has at the feed portion thereof a beater 17 to feed band-like towels, as folded, by a predetermined distance (for example 20 to 30 cm) in the longitudinal direction of the towel band. The immersion tank 5 also has a pair of upper and lower synchronous conveyors 18, between which the band-like towels are holdingly transferred.

In the immersion tank 5, a heated washing solution of a surface active agent mixed with a supplementary agent mentioned earlier is circulated by convection with a pump and a shower means such that the washing solution comes in full contact with both surfaces of the band-like towels.

Two washing tanks 6 are disposed in series and each tank 6 has two roller-shaped brushes 19 rotating in the direction opposite to the towel transfer direction so as to come into contact with both surfaces of the band-like towels. Such contact of the brushes impregnate the towels with the washing solution in the immersion tank 5 thereby permitting removal of stains or spots on the towels. The brushes 19 are constructed such that their distance from the band-like towels is adjustable. Thus, contact pressure of the brushes 19 may be adjusted and wear of the brushes 19 may be absorbed, thereby providing a predetermined contact pressure.

Two rinsing tanks 7 are disposed in series and each tank 7 has two freely rotatable punching drums 20 disposed such that both surfaces of the band-like towels come in contact with the peripheries of the punching drums 20. The rinsing tanks 7 also have sprays 21 to sprayingly supply water or warm water to the band-like towels in contact with the punching drums 20. Thus, the washing solution, and spots or stains washingly removed or ready to be removed may be removed and absorbed to the inside of the punching drums 20 from the band-like towels.

Provision is made such that most of water or warm water used in the rinsing tanks 7 may be recirculated through filters and a portion of such water may be supplied to the immersion tank 5, so that water saving may be realized as much as possible.

The sterilizing device 10 has a steam generator 24 comprising a water reservoir 22 and heating pipes 23 therein through which steam from a boiler B passes. A sterilizing chamber S is formed at the upper portion of the sterilizing device 10 and is covered by a peripheral wall 25. The bandlike towels are continuously carried in and out from the sterilizing chamber S in a zigzag line. The band-like towels stay, for a predetermined period of time (for example, 1 to 60 minutes), in the sterilizing chamber S filled with steam generated by the steam generator 24, thereby annihilating bacilli and, more particularly *Escherichia coli.*

The peripheral wall 25 is a double wall, and between the opposite surfaces thereof there is formed a space $S_1$ for supplying heated steam from the boiler B. In order to avoid dew formation when steam in contact with the peripheral wall 25 is cooled, a heating device 26 is disposed for heating the peripheral wall 25.

A suction blower 27 is provided for collecting steam discharged from towel inlet port 28 and outlet port 29 disposed at the sterilizing chamber S. Supply lines R are disposed for supplying steam directly to the inside of the sterilizing chamber S at the early stage when the steam generator 24 is initially started.

In the sterilizing chamber S, a detector means 30 is disposed for detecting a temperature in the sterilizing chamber S. Adapted to be supplied to and compared at a comparator 32 are a detection signal from the detector means 30 and a signal from a temperature setting device 31 to set the temperature and humidity of steam in the sterilizing chamber S in the range from 98° C. to 102° C. and 98% or more, respectively. According to a result of such comparison, a command signal is adapted to be supplied to an operating circuit 33. In response to the command signal from the operating circuit 33, an electromagnetic valve V disposed in the supply line from the boiler B in the steam generator 24 is operated. Thus, a control device 34 is constructed to automatically adjust the amount of steam to be generated by the steam generator 24 such that the temperature of steam in the sterilizing chamber S is maintained at the range from 98° C. to 102° C. and the humidity of steam at 98% or more.

In the embodiment discussed hereinbefore, the temperature is preset by the setting device 31 such that the temperature and humidity of steam in the sterilizing chamber S are maintained at the range from 98° C. to 102° C. and 98% or more, respectively, whereby sterilization is performed in a satisfactory manner with high heat conduction efficiency. However, even though such temperature and humidity are lowered dependent on the degree of towel stains, it is still possible to achieve a predetermined sterilizing effect, as discussed later. Namely, a predetermined sterilizing effect may be obtained with the temperature and humidity at least maintained at 70° C. and 45%, respectively.

With respect to the steam generator 24, various modifications may be possible. For example, steam independently generated may be supplied to the inside of the sterilizing chamber S, or Nichrome wires instead of heated steam may be disposed in the heating pipes 23.

Figure 4:
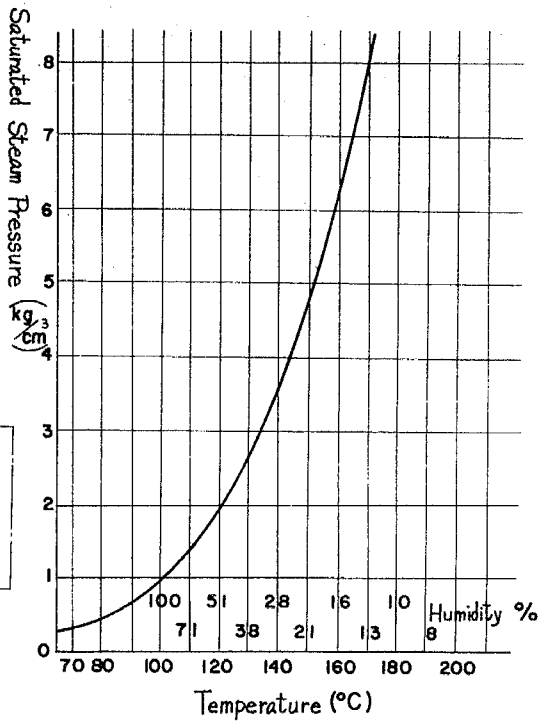
FIG. 4 is a reference graph.

In the embodiment discussed hereinbefore, steam is adapted to be discharged from the sterilizing chamber S to the outside through the inlet and outlet ports 28 and 29 when the sterilizing chamber S is fully filled with steam, and the internal atmospheric pressure may therefore be regarded as 1. FIG. 4 shows the relationship between the saturated steam pressure and the temperature, and also shows the humidity at each temperature when saturated steam was overheated.

The drying device 11 comprises eleven siphon-type steam cylinders 35 in two rows, each cylinder having a width at least three times the width of a towel. The band-like towels are adapted to be dried by passing through these steam cylinders 35 three times.

The outlet-side accumulator unit 12 is constructed similarly as the inlet-side accumulator unit 4. The continuously conveyed band-like towels are adapted to be supplied to the starting end of the accumulator unit 12 and then stored in the container such that the succeeding intermittent operation at the selectively collecting device 13 may readily be performed.

The selective collecting device 13 comprises a winding device 36 for winding up towels one by one with the end portions of towels wound therearound, and a distributing device 37 for receiving and distributing the wound towels. The distributing device 37 is drivingly rotatable around the longitudinal axis Q through a drive mechanism 38.

Disposed between the outlet-side accumulator unit 12 and the winding device 36 is a first detector 41 comprising a projecting light source 39 and a light receiving means 40 which are disposed above and under the conveyed band-like towels, respectively. Also disposed between the outlet-side accumulator unit 12 and the winding device 36 is a second detector 43 for which the light source 39 of the first detector 41 also serves as light source, the second detector 43 having a light receiving means 42 adapted to receive a light from the light source 39 reflected on the band-like towels.

Signals from the first and second detectors 41 and 43, and signals from setting devices 44 and 45 are supplied to and compared at comparators 46 and 47. Based on the result of such comparison, signals are supplied to a selecting circuit 48, where signals from the comparators 46 and 47 are then compared and selected. According to such comparison and selection, a command signal is supplied to an operating circuit 49, by which the drive mechanism 38 is operated to change the rotary angle thereof.

With such arrangement, according to variations of the amount of transmitted light, the first detector 41 may detect damaged towels such as rents and frayed edges, and according to variations of the amount of reflected light, the second detector 43 may detect the washing state of towels as to stains, mold or spots. Dependent on such damage and washing state detected, the rotary angle of the distributing device 37 or the towel collecting position may be automatically changed. Thus, a control device 50 is constructed so as to classify towels, readily and rapidly, into good quality towels capable of being re-used, damaged towels requiring repairs and insufficiently washed towels requiring re-washing.

The description hereinafter will discuss how rolled towels are transferred to the distributing device 37 from the winding device 36.

Figure 2:
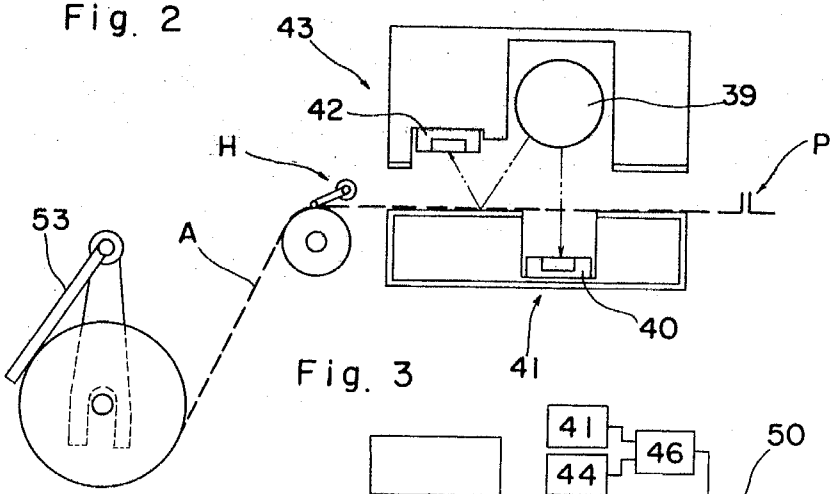
FIG. 2 is an enlarged side view of main portions of the system.
Figure 3:
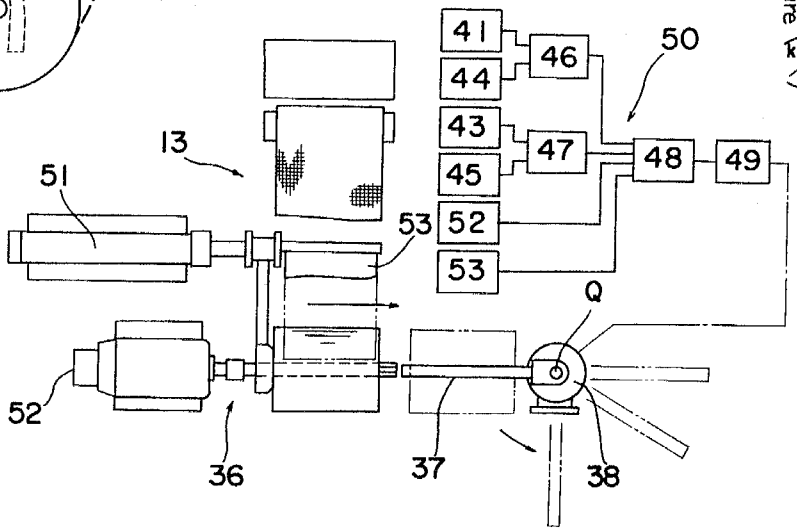
FIG. 3 is a partially developed plan view of the system, particulary showing a control device.

As shown in FIG. 2, interlocking with the winding device 36 is a detector means H adapted to detect the ends of towels A based on the fact that the towel connected portions P have a thickness greater than other portions. When the ends of towels are detected, towel transfer is automatically stopped with the towel ends conveyed to the position opposite to the winding device 36. Subsequent to such towel transfer stop, the machine-sewed thread is manually removed to release the connection of towels. Thereafter, by turning a start switch to ON, a cylinder 51 is operated to convey wound towels to the distributing device 37, simultaneously with the operation of the control device 50.

Furthermore, the winding device 36 has a third detector 52 for detecting the length of a rolled towel according to the number of rotations thereof, and a forth detector 53 to come in contact with the outer peripheral surface of the rolled towel A and to detect the diameter of the rolled towel A according to the swing angle thereof. Signals from the third and forth detectors 52 and 53 are adapted to be supplied to the operating circuit 49. Thus, the incorporation of the third and forth detectors 52 and 53 in the control device 50 permits a highly accurate quality control to be realized; namely, if towels do not comply with standard requirements, even though they are satisfactory in view of the damage and washing state, such towels are excluded as defective.

One example of quality control performed by the control device 50 is shown in the following table.

| Item to be inspected | Inspection standard | Instruction |
|---|---|---|
| Strong stain | 1.0cm × 1.0cm or more | Re-Washing |
| Strong rust | 1.5cm × 1.5cm or more | Re-Washing |
| Light rust/spot | 2.5cm × 2.5cm or more | Re-Washing |
| Edge fraying | 1.0cm W × 1.5cm L or more | Repair |
| Rent | 1.0cm W × 1.0cm L or more | Repair |
| Rolled towel dia. | 2.0 cm or more | Defective |
| Towel length | 30 m or less | Defective |

It is to be noted that application of the present invention is not limited to selective collection of washingly treated towels, but the present invention may also be applied to sheets, and such articles are generally defined as washingly treated articles.

In the embodiment discussed hereinabove, a sterilizing means with the use of ultraviolet rays may be disposed between the sterilizing device 10 and the drying device 11.

Stains of towels are chiefly dirt from the hands (protein, sebum horny substance), and also include red iron mold, blood, lipstick, coloring matter, soy sauce, spots resulted from the propagation of bacilli (mainly black spots by the Aspergillus and green spots by the penicillus genus) or others.

TABLE 1

| | Comparison of Treating Conditions and Effect According to the System of the Present Invention | | | | | | | | | | | | | | | | |
|---|---|---|---|---|---|---|---|---|---|---|---|---|---|---|---|---|---|
| | Stain 1 | | | | | | Stain 2 | | | | | Stain 3 | | | | | |
| Classification of stain | Untreated | 1 | 2 | 3 | 4 | 5 | Untreated | 1 | 2 | 3 | 4 | Untreated | 1 | 2 | 3 | 4 | 5 |
| Condition | | | | | | | | | | | | | | | | | |
| Temperature | | 70 | 70 | 70 | 80 | 90 | | 90 | 95 | 98 | 90 | | 95 | 98 | 98 | 98 | 102 |
| Humidity (%) | | 45 | 45 | 45 | 60 | 70 | | 60 | 70 | 80 | 0 | | 60 | 98 | 98 | 98 | 5 |
| Period of stay time(min.) | | 30 | 40 | 60 | 20 | 20 | | 5 | 20 | 5 | 20 | | 40 | 5 | 1 | 2 | 10 |
| Effect | | | | | | | | | | | | | | | | | |
| Number of washing times | | 174 | 165 | 158 | 125 | 122 | | 167 | 120 | 167 | 103 | | 98 | 145 | 150 | 150 | 82 |
| Tensile strength (kg/cm) | | 4.8 | 4.6 | 4.2 | 3.3 | 3.3 | | 4.6 | 3.2 | 4.6 | 2.5 | | 2.4 | 3.9 | 4.0 | 4.0 | 2.0 |
| Bacilli | | | | | | | | | | | | | | | | | |
| *Escherichia coli* (number/cm$^2$) | 320 | 0 | 0 | 0 | 0 | 0 | 500 | 0 | 0 | 0 | 0 | 1780 | 0 | 0 | 0 | 0 | 0 |
| General bacilli (number/cm$^2$) | 72000 | 185 | 192 | 98 | 82 | 38 | 230000 | 168 | 42 | 122 | 720 | 520000 | 172 | 0 | 115 | 35 | 535 |
| General | | X | X | | | | | X | | | X | | X | | | | X |

TABLE 1-continued

| | Comparison of Treating Conditions and Effect According to the System of the Present Invention | | | | | | | | | | | | | | | |
|---|---|---|---|---|---|---|---|---|---|---|---|---|---|---|---|---|
| | Stain 1 | | | | | | Stain 2 | | | | | Stain 3 | | | | |
| Classification of stain | Un-treated | 1 | 2 | 3 | 4 | 5 | Un-treated | 1 | 2 | 3 | 4 | Un-treated | 1 | 2 | 3 | 4 | 5 |
| Judgment | | | | | | | | | | | | | | | | | |

Notes:
X: Defective below standard requirements
Average although standard requirements are met
Good with standard requirements met
The overall judgment has been made taking into account not only the number of bacilli but also deterioration of the towel fibers based on tensile strength.

These stains may be roughly classified into light stains, light spots, and general contamination (hereinafter referred to as Stain 1), strong stains, light mold and partial strong spots (hereinafter referred to as Stain 2) and stains essentially comprising mold (hereinafter referred to as Stain 3).

The results of tests conducted per each classification are shown in the following table:

It has found from the tests above-mentioned that, when the temperature and the himidity were set to, for example 70° C. and 45% respectively in order to keep down the sterilizing efficiency to the necessary minimum, it was required to adjust the period of stay time but a desired sterilizing effect was still obtained with the period of stay time being 60 minutes or more, as shown in the Table. However, when the temperature or the humidity was set to less than 70° C. or 45%, a desired sterilizing effect was not obtained even though the period of stay time was much extended.

The following table shows a comparison in strength and sterilization between conventional systems in which sodium hypochlorite and high test bleaching power were used as disinfectant, respectively, with effective chlorine concentration of 200 ppm, and the sterilization system in accordance with the present invention in which steam was used as disinfectant.

TABLE 2

| Sterilizing Method | Number of Washing (Sterilizing) times | Tensile Strength | Number of General Bacilli |
|---|---|---|---|
| Sodium hypochlorite | 63 | 1.4 kg/cm | 400/cm$^2$ |
| High test bleaching powder | 71 | 1.6 | 720 |
| Steam(2 minute contact) | 150 | 4.0 | 35 |

For the tests above-mentioned, conventional washing was performed in such a way that towels of a predetermined amount are subjected to washer washing, i.e. washing (one time), sterilization (one time) and rinsing (three times), and are then dehydrated by a centrifugal filter, and then dried with apparatus of the type for drying and winding sheets. In such conventional washing, a solution having an effective chlorine concentration of 200 ppm was used as disinfectant.

From Table 1, it has found that the sterilizing system in accordance with the present invention provides a very high sterilizing effect.

From Table 2, it has found that, in spite of the number of washing times being more than twice, towels washed by the system in accordance with the present invention have two times the tensile strength and exhibit extremely less fiber deterioration with excellent sterilization.

As apparent from Table 1, tensile strength of towels Varies with the humidity. Namely, the provision of a predetermined humidity may not only improve sterilizing effect, but also provide good tensile strength in view of continuous washing of towels.

With respect to the touch of towels after sterilizing treatment, the system in accordance with the present invention does not injure the touch of the component fibers (cotton and/or vinylon, nylon, tetron). That is, when sterilized by low-humidity hot air for example, the component fibers become hard and there is a possibility of such hardened fibers harming the skins of the hands and the face to impart discomfort to the users. On the contrary, the system of the present invention may provide better finishing which imparts no discomfort to the users.

From the foregoing, it will be apparent the present invention has following advantages.

According to the present invention, since steam sterilization is performed while towels are being continuously carried in and out from the sterilizing chamber by the conveyor system 3, it is possible to avoid fiber deterioration, which is observed in a system with the use of chloric type chemicals, whereby towels treated in accordance with the present invention may be repeatedly used for a long period of time, thereby to realize economical improvements, and sterilization may be continuously performed in an effective manner.

If the sterilizing chamber S is merely filled with steam, steam comes in contact with the peripheral wall 25 of the sterilizing chamber S and is subsequently cooled to form dew. Then, there is a possibility of such dew falling on towels and getting spots thereon. However, according to the present system, the heating device 26 heats the peripheral wall 25 to restrain the formation of dew, thereby preventing towels from becoming stained, which is otherwise a result of dew falling.

Furthermore, if the sterilizing chamber S is not sufficiently filled with steam, the humidity of steam is excessively decreased from the fact that the peripheral wall 25 is heated by the heating device 26. Accordingly, the heat conduction effect is lowered too much to perform a desired sterilization.

On the other hand, if the sterilizing chamber S is excessively filled with steam in order to prevent the humidity from being decreased, it increases the running cost of the steam generator 24. However, according to the present invention, since provision is made for detecting a temperature in the sterilizing chamber S, the amount of generated steam may automatically be controlled such that the temperature and the humidity of steam in the sterilizing chamber S are maintained at 70° C. or more and 45% or more, respectively. Thus, steam generation may be restrained to such a minimum amount so as to perform a desired sterilization, thereby reducing the system running cost. As a whole, good sterilization may be performed with economical improvements.

Furthermore, according to the present invention, since sterilization is performed with steam having a predetermined humidity, it is possible to restrain to injure the touch of the component fibers of towels, thus providing a practical advantage.

When rolled towels treated according to the present invention are circulated on the market as rental goods, general bacilli are propagated in transit or during storage dependent on temperature and humidity conditions. Accordingly, it is to be noted that such rental rolled towels are to be generally rented and collected for a cycle of at most one month, in order to always use such rolled towels in a satisfactory manner and to prevent such towels from being excessively contaminated by spots and mold.

We claim:

1. A selective collecting system for washed articles comprising:

means for washing said articles;

means for conveying said articles in a predetermined path through said washing means;

first detector means located along said path for detecting damaged articles, said first detector means including a first light source and first light receiving means for generating a first detection signal responsive to variations in light transmission through said articles received by said first light receiving means, which variations in light transmission have been predetermined to be indicative of damage to the articles;

second detector means located along said path for detecting results of the washing treatment of said articles, said second detector means including a second light source and second light receiving means for generating a second detection signal responsive to variations in light refraction, from at least one surface of said articles, received by said second light receiving means;

means for comparing said first and second detection signals to a first and second predetermined set of values, respectively, and for generating a control signal in response to variations of said first and second detection signals from first and second set values;

control means for controlling the conditions of the washing treatment in response to said control signal;

winding means for winding said articles washed by said washing means into a roll; and distributing means disposed to receive said article rolls from said winding means for selectively distributing and sorting said article rolls in response to said control signal.

2. A system as in claim 1 further comprising:

means for generating steam;

a sterilizing chamber located downstream of said washing means, said sterilizing chamber being connected to said steam generating means adapted to receiving steam generated thereby;

heating means for heating the interior walls of said sterilizing chamber so as to restrain steam condensation thereon;

conveyor means for continuously conveying washed articles through said sterilizing chamber;

temperature detection means in operative association with said sterilizing chamber for generating a temperature control signal representative of the temperature in said sterilizing chamber; and temperature and humidity control means for adjusting the amount of steam generated by said steam generating means in response to said temperature control signal to maintain the interior environment of said sterilizing chamber at a temperature of at least 70° C. and a humidity of at least 45%.

3. A system as in claim 2 wherein said temperature and humidity control means maintains the interior environment of said sterilizing chamber at a temperature of at least 95° C. and a humidity of at least 70%.

4. A system as in claim 2 wherein said temperature and humidity control means maintains the interior environment of said sterilizing chamber at a temperature between about 98° C. and about 102° C. and a humidity of at least 95%.

5. A system as in claims 1, 2, 3 or 4 wherein said washed articles are roll towels and said system further comprises means located upstream of said washing means for connecting the ends of successive towels so that a relatively continuous band of towels is formed.

6. A system as in claim 4 wherein said connecting means includes means for determining the ends of successive towels, and sewing means connected to said end determining means for sewing said successive towel ends together.

* * * * *